US007784390B1

(12) United States Patent
Lowell et al.

(10) Patent No.: US 7,784,390 B1
(45) **Date of Patent: *Aug. 31, 2010**

(54) SOLID-STATE NON-LETHAL DIRECTED ENERGY WEAPON

(75) Inventors: Reid F. Lowell, Ontario, CA (US); Kenneth W. Brown, Yucaipa, CA (US); A-Lan V. Reynolds, Tucson, AZ (US); Alan A. Rattray, Alta Loma, CA (US)

(73) Assignee: Raytheon Company, Waltham, MA (US)

( * ) Notice: Subject to any disclaimer, the term of this patent is extended or adjusted under 35 U.S.C. 154(b) by 467 days.

This patent is subject to a terminal disclaimer.

(21) Appl. No.: 11/867,579

(22) Filed: Oct. 4, 2007

Related U.S. Application Data

(63) Continuation-in-part of application No. 11/207,049, filed on Aug. 18, 2005, now Pat. No. 7,490,538.

(51) Int. Cl.
*F41H 13/00* (2006.01)
*F41C 27/00* (2006.01)

(52) U.S. Cl. ..... 89/1.11; 42/1.08; 42/84

(58) Field of Classification Search ..... 89/1.11; 42/1.08, 84
See application file for complete search history.

(56) References Cited

U.S. PATENT DOCUMENTS

| | | | | |
|---|---|---|---|---|
| 4,325,305 | A | 4/1982 | Pastine | |
| 5,736,908 | A | 4/1998 | Alexanian | |
| 5,886,664 | A * | 3/1999 | Yujiri et al. | 342/351 |
| 6,252,558 | B1 | 6/2001 | Brown | |
| 6,487,950 | B2 | 12/2002 | Samland | |
| 6,559,724 | B2 | 5/2003 | Rosenberg et al. | |
| 6,765,535 | B1 | 7/2004 | Brown | |
| 6,799,499 | B2 | 10/2004 | Seregelyi et al. | |
| 6,843,178 | B2 | 1/2005 | Wood et al. | |
| 7,126,477 | B2 | 10/2006 | Gallivan et al. | |
| 7,490,538 | B2 * | 2/2009 | Lowell et al. | 89/1.11 |
| 2007/0040725 | A1 | 2/2007 | Lowell | |
| 2007/0139247 | A1 | 6/2007 | Brown | |

FOREIGN PATENT DOCUMENTS

| | | |
|---|---|---|
| EP | 1396699 | 3/2004 |
| WO | WO 2007/022339 | 2/2007 |

OTHER PUBLICATIONS

Raytheon, Silent Guardian, Jun. 2006.

(Continued)

*Primary Examiner*—Bret Hayes
(74) *Attorney, Agent, or Firm*—SoCal IP Law Group LLP; Steven C. Sereboff; John E. Gunther

(57) ABSTRACT

There is disclosed a solid state non-lethal directed energy weapon. The non-lethal weapon may include a solid-state source to generate a high-power millimeter-wave initial wavefront, a main reflector, and a sub-reflector to reflect the initial wavefront to the main reflector. The main reflector may direct the reflected wavefront in a bore-sighted direction toward a target. The wavefront directed by the main reflector may have a power density selected to deliver a non-lethal deterring effect on the target.

19 Claims, 10 Drawing Sheets

OTHER PUBLICATIONS

Wikipedia, Active Denial System, 2007.
Malibu Research, FLAPS Antenna Technology.
Walters et al.,"Heating and pain sensation produced in human skin by millimeter waves: comparison to a simple thermal model," 2000.
Walters et al., "Effects of blood flow on skin heating induced by millimeter wave irradiation in humans," 2004.
Blick et al., "Thresholds of microwave-evoked warmth sensation in human skin," 1997.
Riu et al., "A thermal model for human thresholds of microwave-evoked warmth sensation," 1996.
GlobalSecurity.org, "Vehicle-Mounted Active Denial Technology (V-MADS)," Internet, Archived as shown in box at top of page, Jan. 7, 2003, 6 pages.
International Search Report and Written Opinion in re International Patent Application No. PCT/US2006/032117, Feb. 2007.
Hackett, K. E., et al., "Active Denial Technology," http://www.afrlhorizons.com/Briefs/Sept01/De0101.html>, Internet Article, Retrieved from the Internet Jan. 22, 2007.

* cited by examiner

SOLID-STATE NON-LETHAL DIRECTED ENERGY WEAPON

RELATED APPLICATION INFORMATION

This patent is a continuation-in-part of application Ser. No. 11/207,049, "Weapon having lethal and non-lethal directed energy portions", filed Aug. 18, 2005, now U.S. Pat. No. 7,490,538 B2.

BACKGROUND

1. Field

This disclosure relates to non-lethal directed energy weapons.

2. Description of the Related Art

There are many difficult quickly changing situations in modern urban conflicts that security personnel must deal with. In modern urban conflicts, security personnel must execute dynamically changing missions that could shift rapidly between direct action, security patrols and civil stability. Among the mix of unarmed civilians, non-lethal combatants (e.g., rock throwing) and lethal combatants, it is often not immediately clear who is an innocent bystander and who poses an immediate threat to security personnel. Options for security personnel many times progress quickly from shouting to shooting. Modern urban conflicts many times require a delicate balance between the use of non-lethal force and the use of lethal force. Non-lethal weapons, when available, are generally carried separate from lethal weapons resulting in a potentially life-threatening delay for security personnel when switching between the types of weapons. Urban riot situations, for example, can easily escalate in a moment's notice and require security personnel to switch between a non-lethal response and a lethal response.

One problem with many non-lethal weapons is that they are largely ineffective over the range that lethal weapons are effective. For example, a non-lethal kinetic weapon that sends projectiles (e.g., rubber bullets) must have a reasonable range to maintain its nonlethality, however, the weapon becomes potentially lethal at close range when powerful enough to be used for longer ranges due to the initial velocity required to project the projectile over these longer ranges.

Thus, there are general needs for a non-lethal weapon that can easily be deployed. There are also needs for a combined lethal/non-lethal weapon that has an effective non-lethal range comparable to its lethal range. There are also needs for a combined lethal/non-lethal weapon that allows security personnel to easily and quickly switch between non-lethal and lethal capabilities.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

A weapon in accordance with some embodiments of the present invention combines lethal capability with non-lethal capability allowing a user to easily switch between lethal and non-lethal force in a moment's notice. In many urban conflict situations, this ability may help save the lives of security personnel as well as the lives of innocent non-combatants. The non-lethal portion uses directed energy which, unlike many other non-lethal weapons (e.g., rubber bullets, taser, water cannons), generally causes no residual damage to a person fired upon. Because energy is the ammunition, the logistical burdens associated with conventional non-lethal weapons are significantly reduced.

Figure 1:
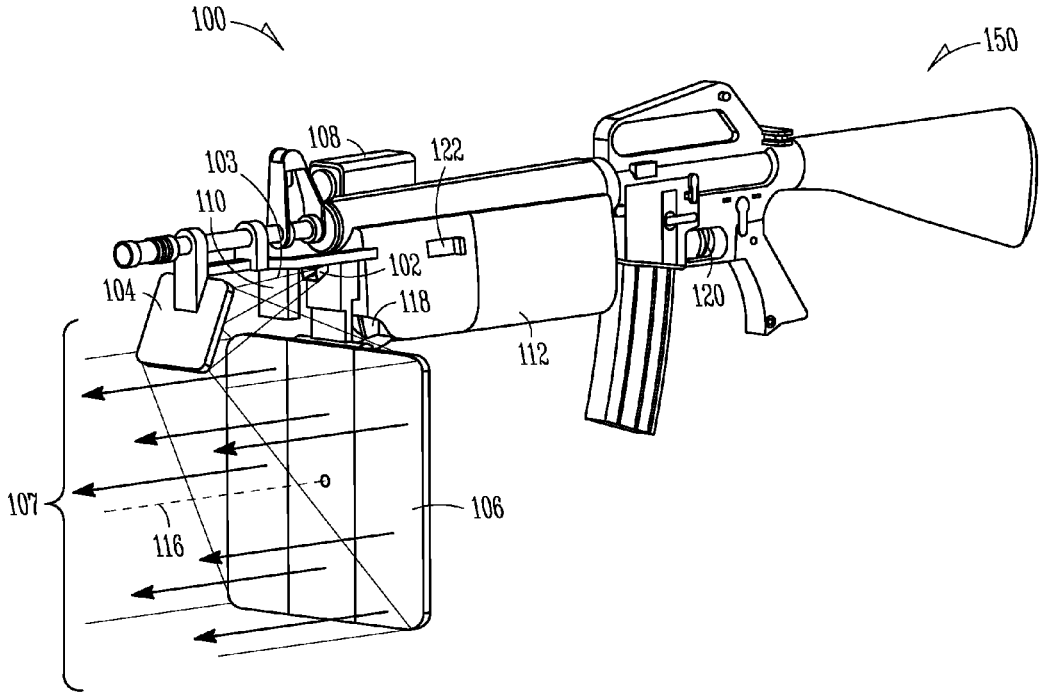
FIG. 1 is a perspective view of a combined lethal and non-lethal weapon.

FIG. 1 is a perspective view of a weapon in accordance with some embodiments of the present invention. Weapon 100 comprises a non-lethal portion and a lethal portion 150. The lethal portion 150 may be any lethal weapon including a rifle or machine gun. The non-lethal portion may comprise a directed energy weapon and may be bore-sighted or aligned with the lethal portion. In some embodiments, the non-lethal portion may be a kit allowing non-lethal capability to be added to a lethal weapon, although the scope of the invention is not limited in this respect.

The non-lethal portion of weapon 100 may comprise an output antenna 102 to transmit a high-power millimeter-wave initial wavefront 103, a main reflector 106, and a sub-reflector or sub-reflectors 104 to reflect and shape the initial wavefront 103 to the main reflector 106. The main reflector 106 may direct wavefront 107 in a bore-sighted direction toward a target.

In some embodiments, non-lethal portion of weapon 100 may also comprise rangefinder 108 to determine a range to the target, focus module 110 to focus wavefront 107, replaceable energy-storage module 112 to provide energy to the non-lethal portion, and laser designator 116 for designating the target. In some embodiments, non-lethal portion may also include trigger 118 to cause the generation of wavefront 107 and on-off switch 122. These elements are discussed in more detail below.

In some embodiments, wavefront 107 may comprise a millimeter-wave frequency, such as a W-band frequency between 94 and 96 GHz, although the scope of the invention is not limited in this respect. In some embodiments, wavefront 107 directed by main reflector 106 may have a power density selected to deliver a non-lethal deterring effect on the target. In some embodiments, wavefront 107 comprises a frequency selected to penetrate a shallow skin-depth (i.e., of less than five millimeters). In some embodiments, a power density of wavefront 107 at the target may be calculated and selected to cause a deterring effect by inducing pain on human skin. In some embodiments, wavefront 107 may comprise W-band millimeter-wave or higher frequency radiation selected to penetrate only a shallow skin-depth allowing the energy to heat the region of the skin's pain sensors, although the scope of the invention is not limited in this respect.

In some embodiments, main reflector 106 may be a collimating reflector to generate a collimated wavefront toward the target. The collimated wavefront may be substantially uniform in amplitude and/or substantially coherent in phase in a planar cross-section of a column of energy emanating from main reflector 106, although the scope the invention is not limited in this respect.

In some other embodiments, main reflector 106 may generate a converting wavefront which may converge at or near an intended target. In these embodiments, a convergence distance may be selected to provide a predetermined power density at or near a surface of the target. In some embodiments, main reflector 106 may generate a slightly diverging wavefront. In some embodiments, the focus of wavefront 107 (i.e., whether wavefront 107 is converging, collimated or diverging) may be at least partially controlled by focus module 110.

In some embodiments, main reflector 106 may be aligned with sights of lethal portion 150 of weapon 100. In some embodiments, the non-lethal portion may be a bore-sighted attachment kit to add non-lethal capability to a lethal weapon. The kit may be a "B-kit" add-on to a rifle, such as an M-16 rifle, although the scope of the invention is not limited in this respect.

Figure 2:
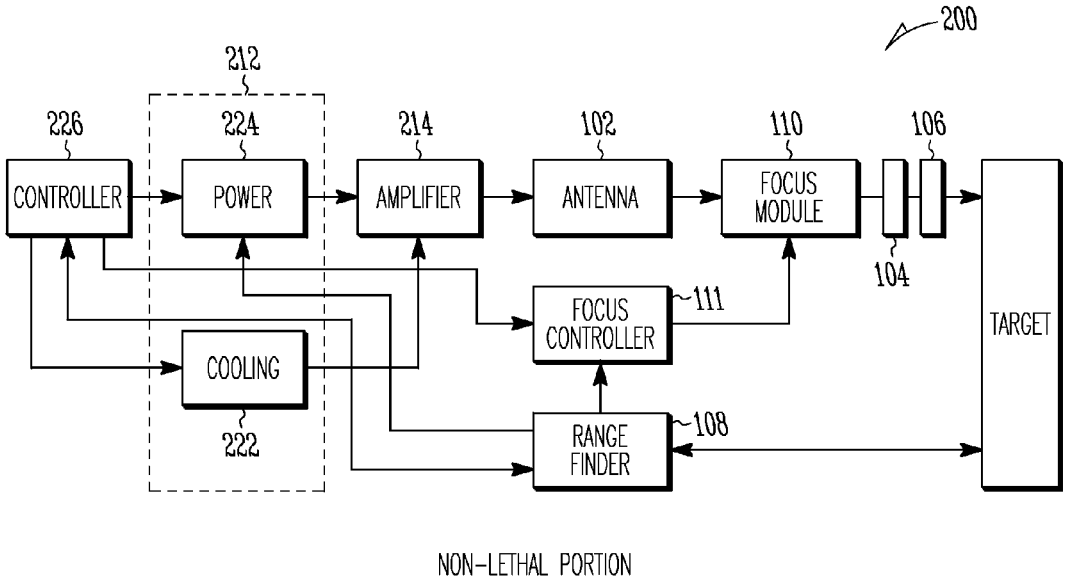
FIG. 2 is a functional block diagram of the non-lethal portion of the weapon of FIG. 1.

FIG. 2 is a functional block diagram of the non-lethal portion of the weapon of FIG. 1 in accordance with some embodiments of the present invention. Elements illustrated in FIG. 2 having the same reference number as elements in FIG. 1 may refer to the same element. As illustrated in FIG. 2, non-lethal portion 200 may include system controller 226 to control the operation of the various elements of non-lethal portion 200. Rangefinder 108 may determine a distance to the target and system controller 226 may determine the proper power density of wavefront 107 at or near the target based on the distance. System controller 226 may control the RF power output of amplifier 214 accordingly. On-off switch 122 may allow power to be turned off to the active elements of the non-lethal portion.

Referring to FIGS. 1 and 2 together, in some embodiments, laser designator 116 may be used to visually designate the target. Laser designator 116 may be bore-sighted with both the lethal portion and non-lethal portion. In some embodiments, rangefinder 108 may be aligned with laser designator 116. In some embodiments, rangefinder 108 comprises a laser-rangefinder, although the scope of the invention is not limited in this respect.

In some embodiments, laser designator 116 may generate a laser-beam in parallel to wavefront 107 and may comprise a laser-diode mounted on main reflector 106. In some embodiments, laser designator 116 may shine through a small hole in main reflector 106. In some alternate embodiments, a laser diode may be provided at or near output antenna 102 and a laser-beam may be reflected by optically reflective portions on reflectors 104 and 106 and may be provided parallel to wavefront 107.

Focus module 110 may change a focus of initial wavefront 103 generated by output antenna 102 based on a distance to the target. This may allow the power-density of wavefront 107 to be adjusted based on the distance to the target. In some embodiments, focus module 110 may be moveable by a user allowing the user to select a position for a focusing element based on the distance to the target. In some embodiments, the focusing element may be manually slidable by a user.

In some embodiments, focus module 110 comprises a millimeter-wave radio-frequency (RF) lens that may be positioned by focus controller 111 based on a distance to a target. In some embodiments, focus module 110 may include one or more RF lenses that may be switched in and out of the RF path by focus controller 111 to focus wavefront 107. In some embodiments, focus controller 111 may change the relative position of sub-reflector 104 to focus wavefront 107, in which case sub-reflector 104 and focus module 110 may be the same element. In some other embodiments, system controller 226 may change the phasing of electronic phase shifters within main reflector 106 to change the focusing and phase distribution of wavefront 107.

In yet some other embodiments, focus module 110, output antenna 102 and amplifier 214 may be combined in an active lens-array in which a plurality of active array elements receive the wavefront, amplify the wavefront, and retransmit the wavefront. The active array elements may include electronic phase shifters to change the focusing and phase distribution of initial wavefront 103, which will cause a corresponding change in the focus of wavefront 107.

In some embodiments, focus module 110 may provide a continually variable focusing distance, while in other embodiments; focus module 110 may provide selectable discrete focusing steps. In some embodiments, focus controller 111 and/or system controller 226 may configure main reflector 104, sub-reflector 104 and/or focus module 110 to generate a collimated wavefront, while in other embodiments; focus controller 111 and/or system controller 226 may configure main reflector 106, sub-reflector 104 and/or focus module 110 to generate a converting wavefront. In some other embodiments, focus controller 111 and/or system controller 226 may configure main reflector 104, sub-reflector 104 and/or focus module 110 to generate a slightly diverging wavefront.

In some embodiments, rangefinder 108 and/or focus module 110 are optional. In these embodiments, the focus of the non-lethal portion may be set at a predetermined distance or at infinity. In these embodiments, the power output of amplifier 214 may be varied, although the power output may also be set to a predetermined level.

In some embodiments, focus controller 111 may change a focus of focus module 110 in response to changes in a distance to the target provided by rangefinder 108. In some of these embodiments, a convergence point of wavefront 107 may be selected by system controller 226 to generate a predetermined power density at or near a target.

In some embodiments, amplifier 214 may be high-power millimeter-wave amplifier coupled to output antenna 102 to generate a high-power RF signal. In some embodiments, amplifier 214 may comprise a solid-state millimeter-wave amplifier comprising a plurality of either Silicon (Si), Gallium-Arsenide (GaAs), Indium Phosphide (InP), Gallium Nitride (GaN) or other semiconductor amplifier elements. Amplifier 214 may be comprised of an array of solid-state semiconductor amplifiers, each of which is coupled to a corresponding antenna in an array of antenna elements. The wavefronts radiated from the array of antenna elements may be spatially combined to form the initial wavefront 103. In this case, output antenna 102 may be the distributed across the amplifier array and may not exist as a discrete element.

In some embodiments, output antenna 102 may be a horn antenna and initial wavefront 103 may be a substantially spherical wavefront. In some embodiments, initial wavefront 103 may be a substantially planer wavefront spatially combined from wavefronts radiated by an array of antenna elements driven by a corresponding array of solid state amplifier devices.

Replaceable and removable energy-storage module 212 may provide electrical energy for the millimeter-wave amplifier 214 and/or other elements of the non-lethal portion. In some embodiments, energy-storage module 212 comprises power element 224 which may include, for example, either batteries or a fuel cell. In some embodiments, energy-storage module 212 may comprise a disposable battery or power pack, although the scope of the invention is not limited in this respect.

In some embodiments, weapon 100 may further comprise cooling element 222 to cool amplifier 214. In some embodiments, cooling element 222 may be part of replaceable energy-storage module 212, although the scope of the invention is not limited in this respect.

In some embodiments, cooling element 222 may circulate a fluid coolant to cool amplifier 214. In some embodiments, the coolant may comprise a liquid or gas that is simply expended as the weapon is discharged, and cooling element 222 may include a reservoir to store the liquid. In some embodiments, cooling element 222 may use an expanding gas to cool the amplifier 214. In these embodiments, cooling element 222 may include a pressurized reservoir to store the gas. In some embodiments, the gas may comprise carbon-dioxide (CO2), although the scope of the invention is not limited in this respect. In the embodiments including a coolant reservoir, the reservoir may be recharged by refilling the reservoir with the appropriate material.

In some embodiment, cooling element 222 may circulate a fluid to transfer heat from the amplifier 214 to a heat-storage reservoir, which may be filled with a phase change material. The phase change material may be an inorganic or organic material, for example a wax, that is capable of absorbing a large quantity of heat while changing from a solid phase to a liquid phase, or from a liquid phase to a gas phase. In the embodiments including a heat-storage reservoir, the reservoir may be recharged by cooling the reservoir sufficiently to reverse the phase change such that the phase change material reverts to its original solid or liquid phase.

In the embodiments using a coolant reservoir or a heat storage reservoir, the reservoir, including the material therein, may be replaceable. The reservoir may be integrated with and replaced with energy-storage module 212. In these embodiments, the reservoir may be recharged at the same time that the energy-storage module is recharged.

In some other embodiments, cooling element 222 may comprise a semiconductor-based thermo-electric cooling (TEC) element to remove heat from amplifier 214 using electric current, although the scope of the invention is not limited in this respect.

Although FIG. 2 illustrates replaceable module 212 as including power element 224 and cooling element 222, the scope of the invention is not limited in this respect. In some embodiments, replaceable module may also include other elements of non-lethal portion 200.

Although non-lethal portion 200 is illustrated as having several separate functional elements, one or more of the functional elements may be combined and may be implemented by combinations of software-configured elements, such as processing elements including digital signal processors (DSPs), and/or other hardware elements. For example, some elements, such as system controller 226 (FIG. 2) and or focus controller 111 (FIG. 2) may comprise one or more microprocessors, DSPs, application specific integrated circuits (ASICs), and combinations of various hardware and logic circuitry for performing at least the functions described herein. In some embodiments, the functional elements of non-lethal portion 200 (FIG. 2) may refer to one or more processes operating on one or more processing elements.

In some embodiments, weapon 100 may further comprise lethal-weapon trigger 120 to fire the lethal portion of the weapon and non-lethal-weapon trigger 118 to fire the non-lethal portion by generating wavefront 107.

In accordance with some embodiments, non-lethal portion may operate as follows. Switch 122 may be turned on providing power to amplifier 214 and other elements of non-lethal portion and allowing range-finder 108 to determine a distance to a target. Laser-designator 116 may also be activated to designate the target to the user, however in some embodiments; laser-designator 116 may part of lethal portion 150 and may operate independent of the non-lethal portion. Focus module 110 may adjust the power output of amplifier 214 and/or may focus the various elements based on the target's distance. In some embodiments, the power output and focus may be adjusted based on a distance to the target to provide a predetermined power density (i.e., spot size) at the target. When trigger 118 is pulled, wavefront 107 is generated to deter the target. If use of non-lethal force is not successful, the user may easily switch to lethal force.

In some embodiments, lethal portion 150 comprises a machine gun; however, lethal portion 150 of weapon 100 may comprise almost any type of gun including hand-held guns. In some embodiments, the lethal portion may comprise a rifle or a machine gun, such as an M-16 rifle, although the scope of the invention is not limited in this respect.

In some embodiments, sub-reflector 104 may have a substantially flat millimeter-wave reflective surface. In some other embodiments, sub-reflector 104 has a millimeter-wave reflective surface comprising at least a portion of a substantially hyperboloidal, ellipsoidal or paraboloidal surface. Other specifically tailored reflective surfaces or lenses may also be used.

In some embodiments, main reflector 106 may comprise a geometrically-flat electrically-parabolic surface reflector antenna having a plurality of antenna elements to receive and retransmit an incident wavefront, although the scope of the invention is not limited in this respect. In these embodiments, the antenna elements may have circumferentially varying sizes and may be arranged around a center of the main reflector. In some embodiments, the antenna elements may have their electrical shapes optimized to generate either a collimating or converging wavefront of desired power densities. In some embodiments, the antenna elements may comprise a plurality of dual-polarized dipoles that circumferentially vary in size, although the scope of the invention is not limited in this respect. In some embodiments, the antenna elements may each provide approximately a 0 to 360 degree phase shift, although the scope of the invention is not limited in this respect. In some embodiments, the individual antenna elements may have varying sizes and shapes to receive the wavefront reflected by sub-reflector 104 and generate output wavefront 107 as either a collimated wavefront or a converting wavefront. An example of a reflector suitable for use as main reflector 106 may include the geometrically-flat electrically-parabolic surface reflector antenna disclosed in U.S. Pat. No. 4,905,014, although other reflective elements may also be suitable.

In some embodiments, main reflector 106 may be coupled by a hinge to the weapon 100 to allow main reflector 106 to fold back when the non-lethal portion is not being used. In some embodiments, main reflector 106 is foldable and may fold into two or more flat sections. One of the sections may be coupled by a hinge to weapon 100, and the two or more flat sections may fold up at least partially around the weapon.

In some other embodiments, main reflector 106 comprises a single flat panel and is detachable from weapon 100. In these embodiments, main reflector 106 may be stored in a user's backpack, for example, although the scope of the invention is not limited in this respect. In some embodiments, main reflector 106 may be able to be snapped-on to weapon 100.

Figure 3A:
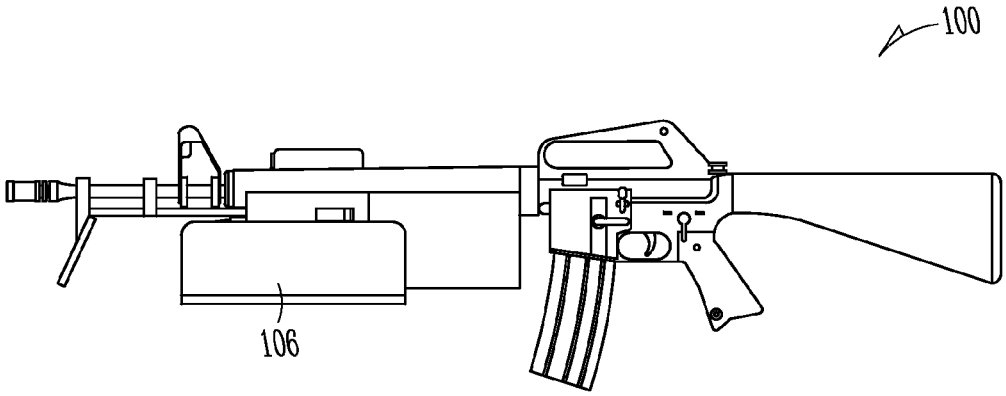
FIG. 3A is a side view illustrating the main reflector in a fully folded-up position.
Figure 3B:
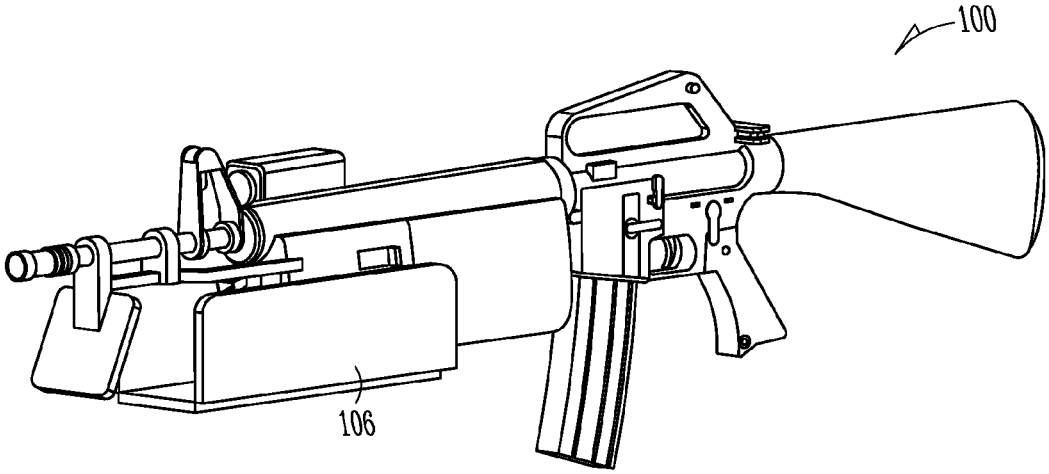
FIG. 3B is a perspective view illustrating the main reflector in a fully folded-up position.
Figure 3C:
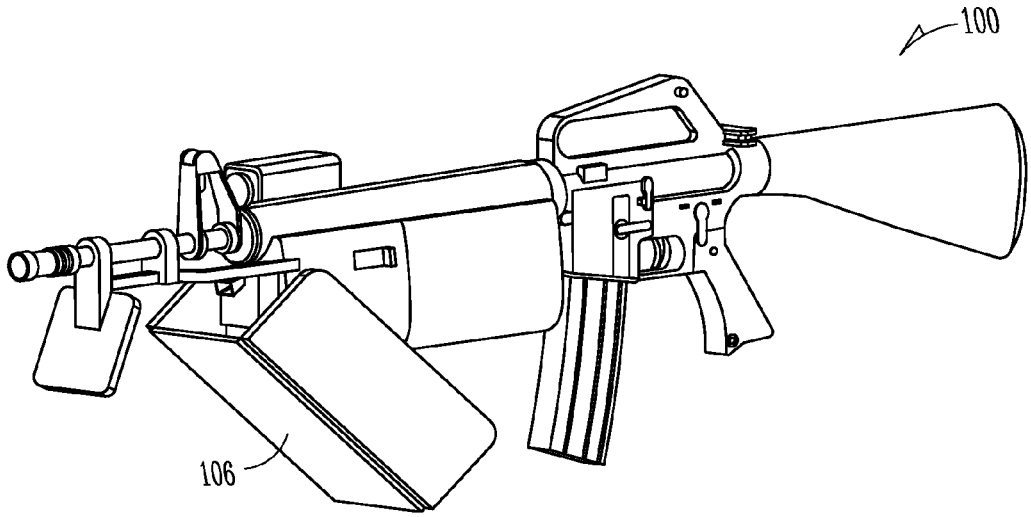
FIG. 3C is a perspective view illustrating the main reflector in a partially folded-up position.
Figure 3D:
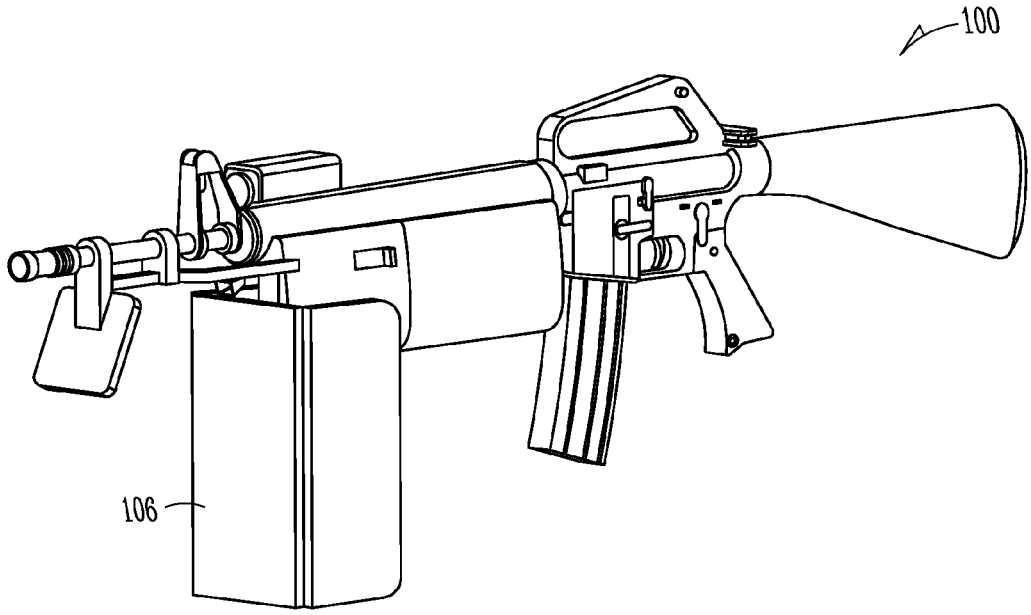
FIG. 3D is a perspective view illustrating wings of the main reflector folded-up.
Figure 3E:
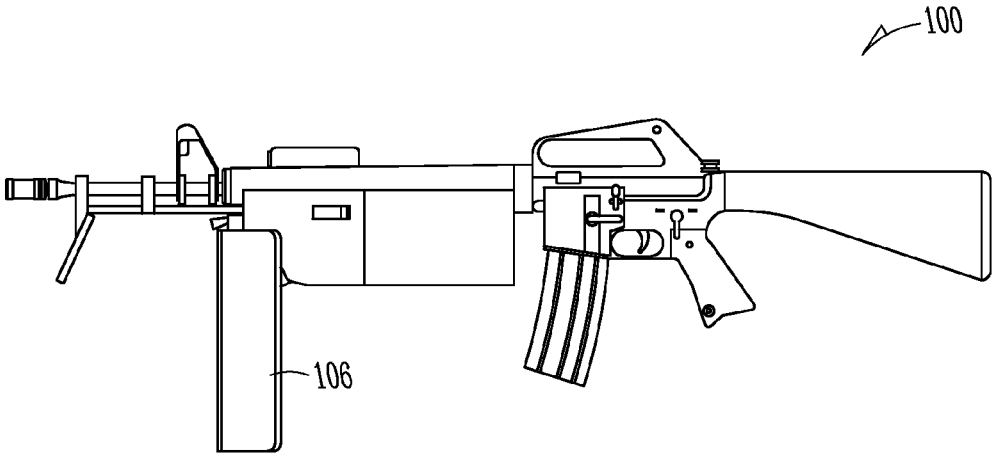
FIG. 3E is a side view illustrating wings of the main reflector partially folded-up.
Figure 3F:
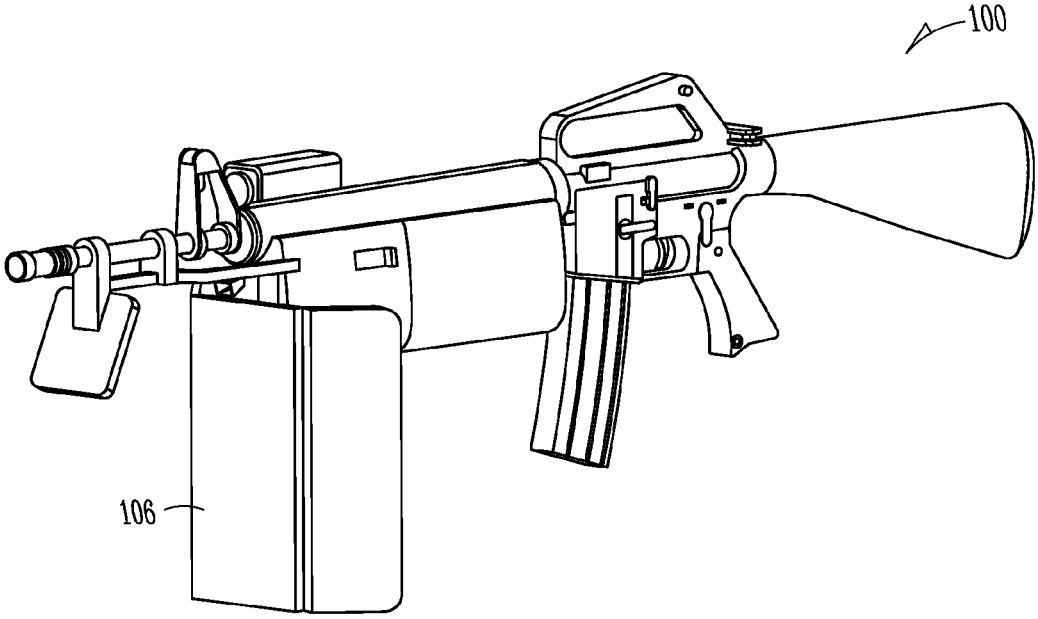
FIG. 3F is a perspective view illustrating wings of the main reflector partially folded-up.

FIGS. 3A-3F illustrate embodiments of the present invention having a foldable main reflector in which main reflector 106 folds up and wraps around the body of weapon 100 when the non-lethal portion is not in use. FIG. 3A is a side view illustrating main reflector 106 in a fully folded-up position in accordance with some embodiments of the present invention. FIG. 3B is a perspective view illustrating main reflector 106 in a fully folded-up position in accordance with some embodiments of the present invention. FIG. 3C is a perspective view illustrating main reflector 106 in a partially folded-up position in accordance with some embodiments of the present invention. FIG. 3D is a perspective view illustrating wings of main reflector 106 folded-up in accordance with some embodiments of the present invention. FIG. 3E is a side view illustrating wings of main reflector 106 partially folded-up in accordance with some embodiments of the present invention. FIG. 3F is a perspective view illustrating wings of main reflector 106 partially folded-up in accordance with some embodiments of the present invention.

Figure 4A:
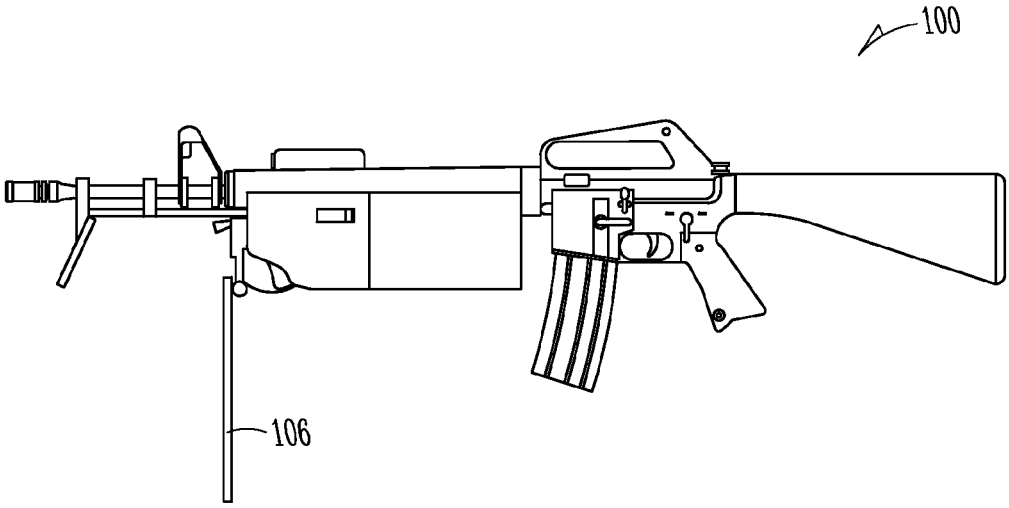
FIG. 4A is a side view illustrating the main reflector in a fully-deployed position.
Figure 4B:
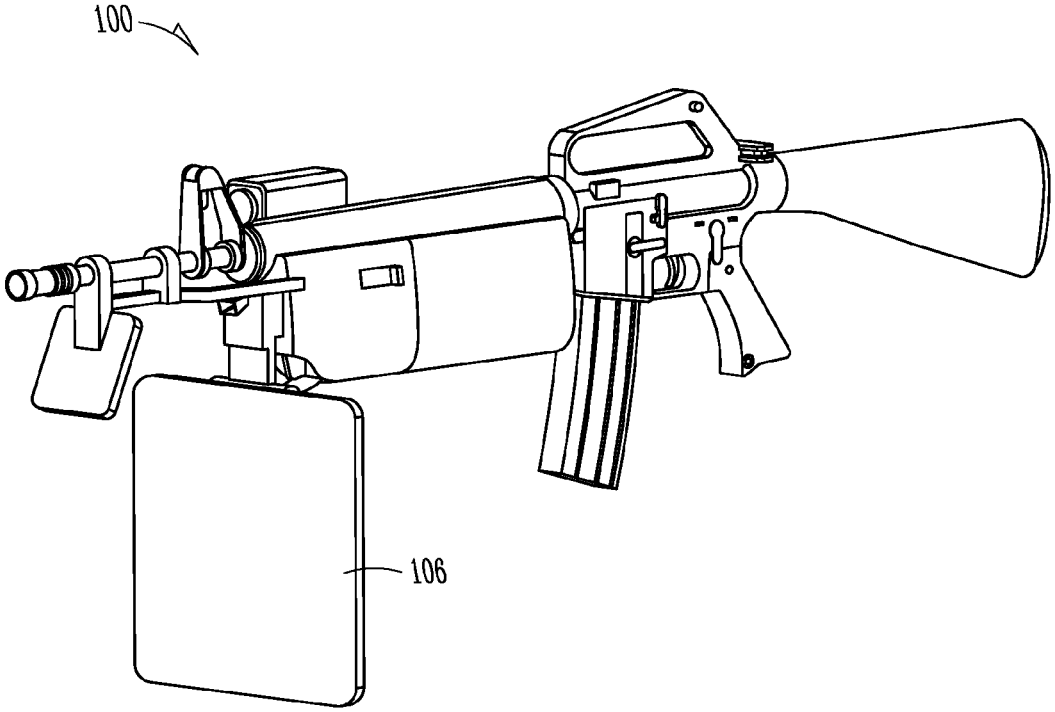
FIG. 4B is a perspective view illustrating the main reflector in a fully-deployed position.
Figure 4C:
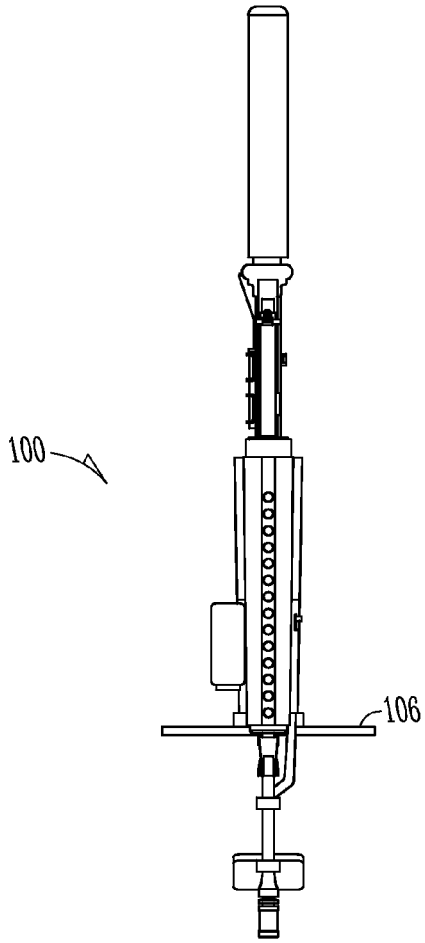
FIG. 4C is a top view of the weapon illustrated in FIGS. 4A and 4B.

FIG. 4A is a side view illustrating main reflector 106 in a fully-deployed position in accordance with some embodiments of the present invention. FIG. 4B is a perspective view illustrating main reflector 106 in a fully-deployed position in accordance with some embodiments of the present invention. FIG. 4C is a top view of the weapon illustrated in FIGS. 4A and 4B. In these embodiments, main reflector 106 may be coupled by a hinge to weapon 100 to allow main reflector 106 to fold back when the non-lethal portion is not being used. In these embodiments, main reflector 106 comprises a single flat panel and may be detachable from weapon 100. In these embodiments, main reflector 106 may be stored in a user's backpack, for example, although the scope of the invention is not limited in this respect. In some embodiments, main reflector 106 may be able to be snapped-on to weapon 100.

Figure 5A:
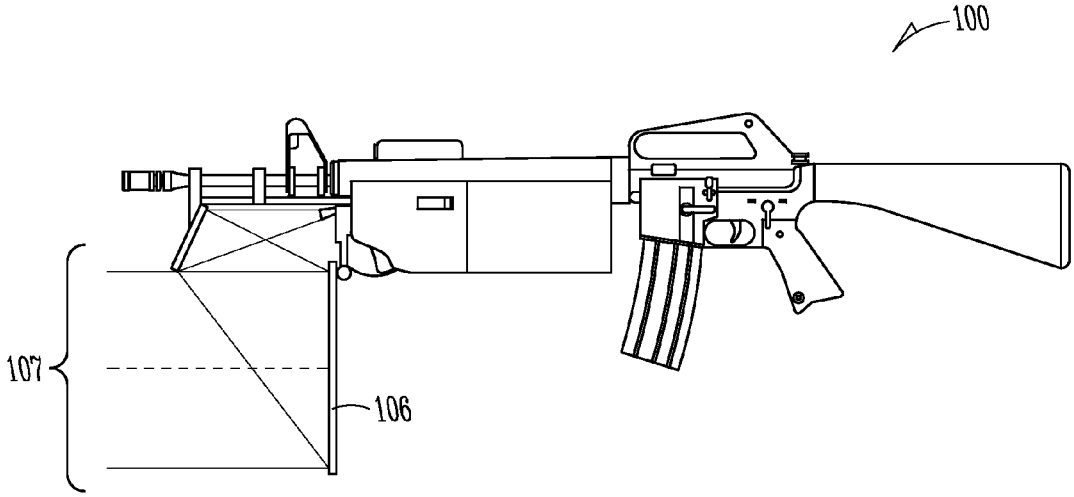
FIG. 5A is a side view illustrating the operation of the non-lethal portion of a combined lethal and non-lethal weapon.
Figure 5B:
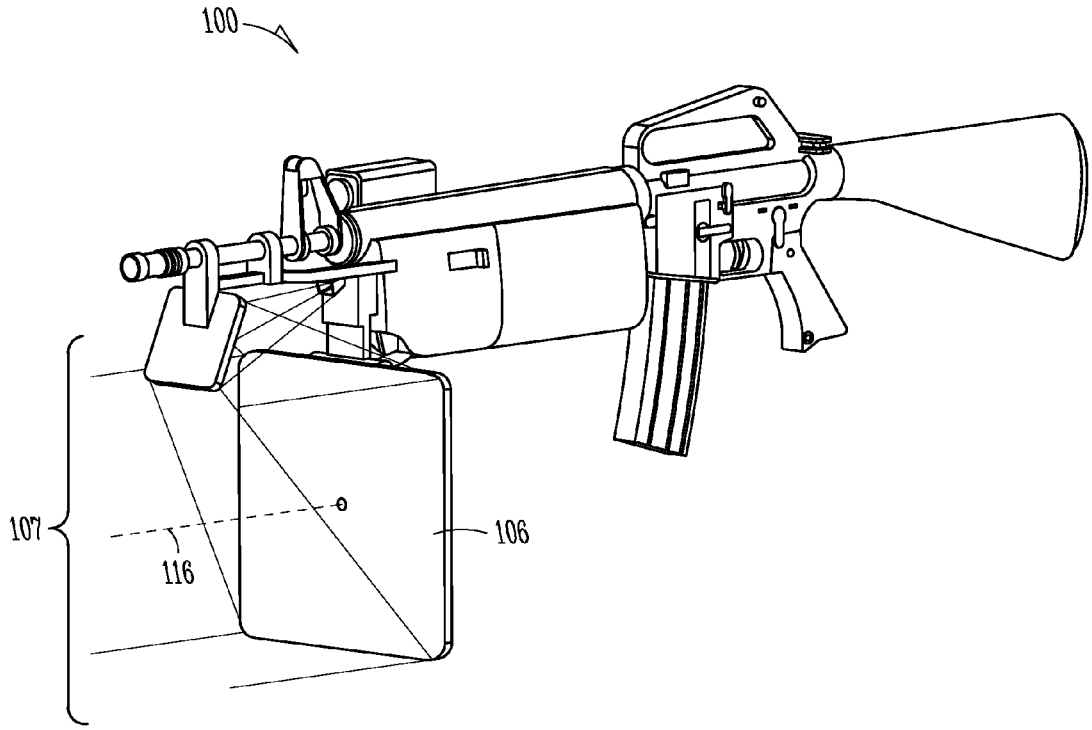
FIG. 5B is a perspective view illustrating the operation of the non-lethal portion of a combined lethal and non-lethal weapon.

FIG. 5A is a side view illustrating the operation of the non-lethal portion of the weapon in accordance with embodiments of the present invention. FIG. 5B is a perspective view illustrating the operation of the non-lethal portion of the weapon in accordance with embodiments of the present invention. The non-lethal portion is illustrated generating wavefront 107 toward a target.

Figure 6A:
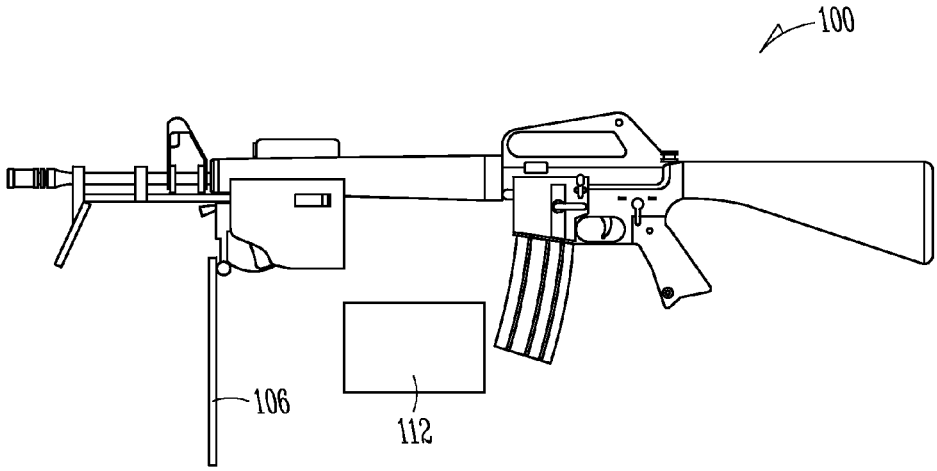
FIG. 6A is a side view illustrating a removable energy-storage module.
Figure 6B:
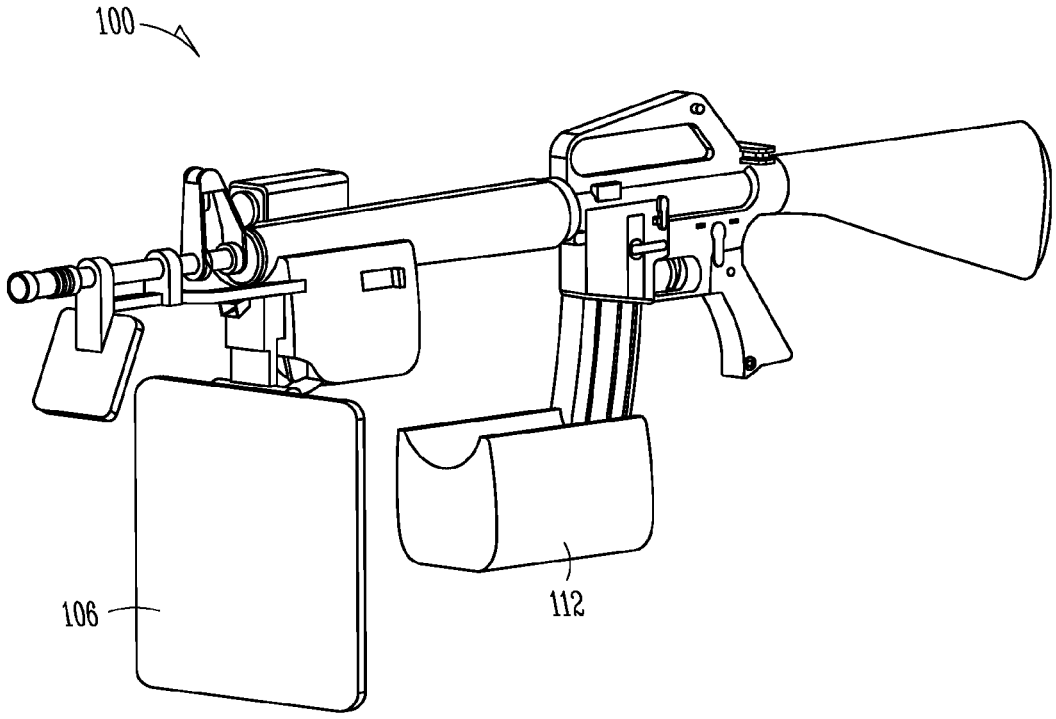
FIG. 6B is a perspective view illustrating the removable energy-storage module.

FIG. 6A is a side view illustrating the removable energy-storage module 112 in accordance with embodiments of the present invention. FIG. 6B is a perspective view illustrating the removable energy-storage module 112 in accordance with embodiments of the present invention.

Figure 7A:
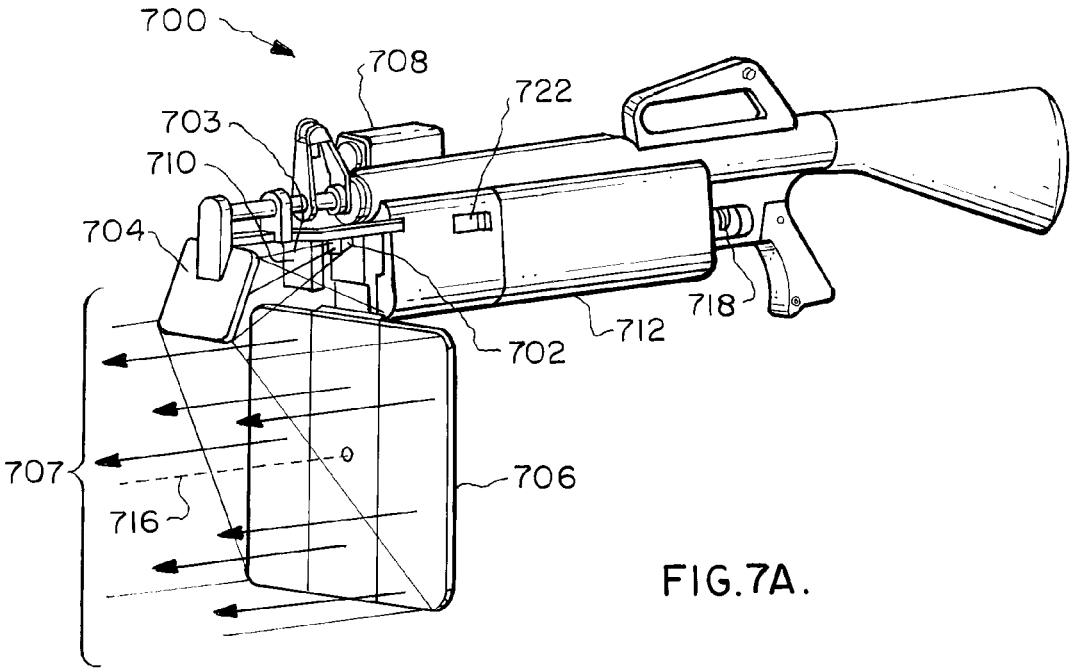
FIG. 7A is a perspective view of a solid-state non-lethal weapon.

FIG. 7A is a perspective view of a solid-state non-lethal weapon 700 that may be similar in function and operation to the non-lethal portion 100 of the combined lethal and non-lethal weapon shown in FIG. 1. Elements in FIG. 7 identified by reference designators may have the same function as elements identified by reference designators having the same two least-significant digits in FIG. 1. The functional architecture of the non-lethal weapon 700 may be same as that of the non-lethal portion 200 of the combined weapon, as described in conjunction with FIG. 2.

Figure 7B:
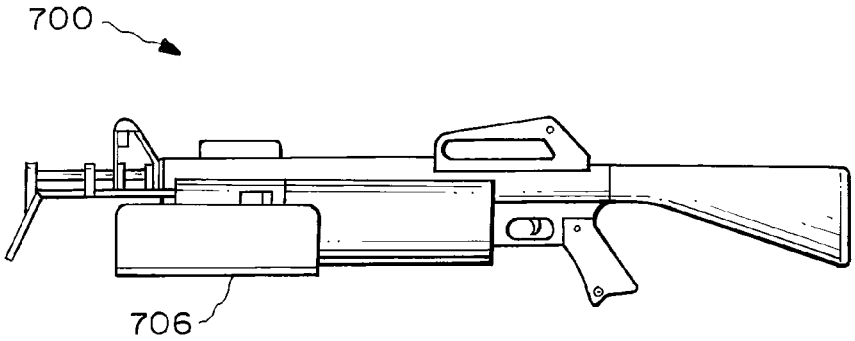
FIG. 7B is a side view of the solid-state non-lethal weapon of FIG. 8A illustrating the main reflector in a fully folded-up position.

The non-lethal weapon 700 does not require the magazine or other components of the lethal portion of the combined weapon. Thus the non-lethal weapon 700 may include a removable energy-storage module 712 which is significantly larger and heavier than the removable energy-storage module 112 of the combined weapon. FIG. 7B is a side view of the non-lethal weapon 700 showing the reflector in the fully folded-up position, as was previously described with respect to the combined lethal and non-lethal weapon 100.

Figure 8A:
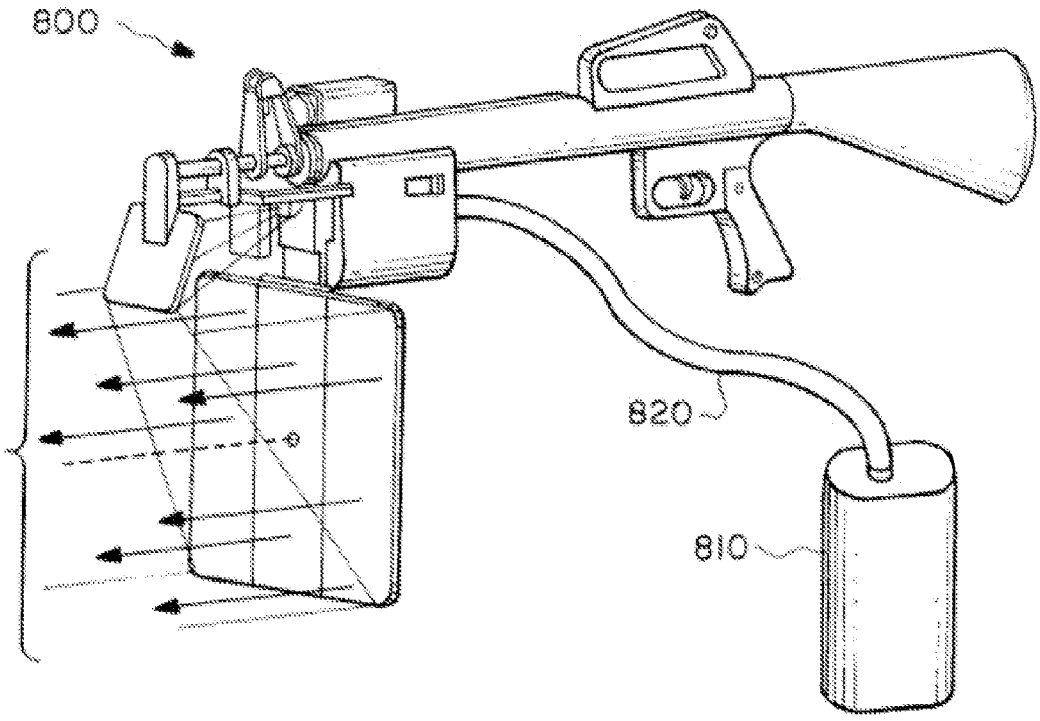
FIG. 8A is a perspective view of another solid-state non-lethal weapon.
Figure 8B:
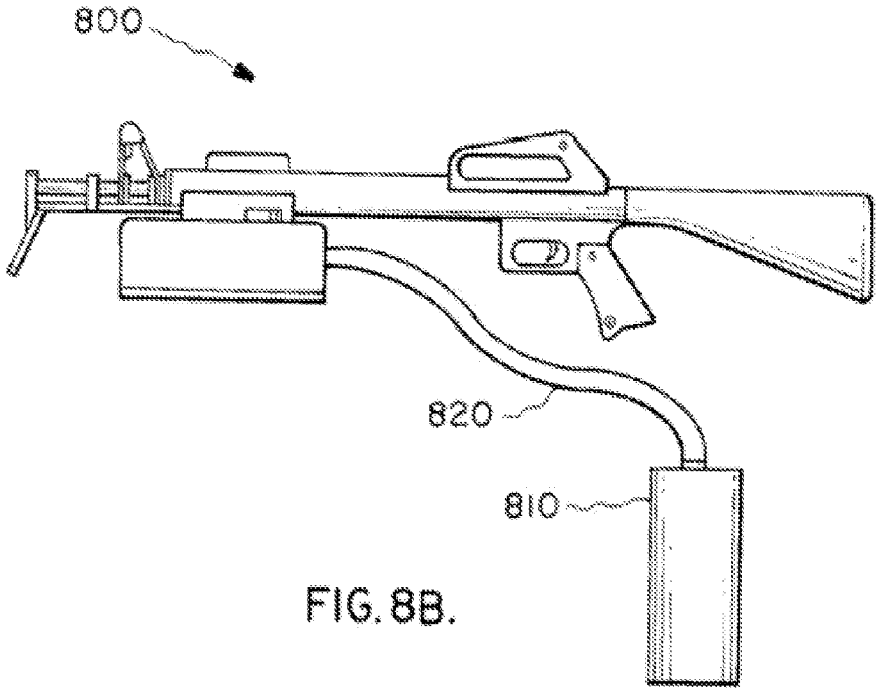
FIG. 8B is a side view of the solid-state non-lethal weapon of FIG. 8A illustrating the main reflector in a fully folded-up position.

FIG. 8A is a perspective view of another solid-state non-lethal weapon 800 that may be similar in function and operation to the non-lethal weapon 700, except that an energy storage module 810 may be a separate unit connected to the non-lethal weapon 800 by an umbilical cable 820. The energy storage module 810 may be suitable for carrying on a belt or as a backpack. The non-lethal weapon 800 may or may not be capable of accepting a removable energy storage unit such as energy storage unit 712. FIG. 8B is a side view of the non-lethal weapon 800 showing the reflector in the fully folded-up position, as was previously described with respect to the combined lethal and non-lethal weapon 100.

Closing Comments

The foregoing is merely illustrative and not limiting, having been presented by way of example only. Although examples have been shown and described, it will be apparent to those having ordinary skill in the art that changes, modifications, and/or alterations may be made.

Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of" respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

The invention claimed is:

1. A non-lethal weapon comprising:

a solid-state source to transmit a high-power millimeter-wave initial wavefront a main reflector a sub-reflector to reflect the initial wavefront to the main reflector wherein the main reflector is to direct the reflected wavefront in a bore-sighted direction toward a target, wherein the wavefront directed by the main reflector comprises W-band millimeter-wave frequency radiation selected to penetrate a shallow skin-depth of human skin allowing the radiation to heat a region of the skin that includes pain sensors, and wherein a power density at the target is selected to cause a non-lethal deterring effect on the target by inducing pain on the human skin.

2. The non-lethal weapon of claim 1, wherein the sub-reflector has a millimeter-wave reflective surface comprising at least a portion of one of a substantially hyperboloid, ellipsoid or paraboloid surface.

3. A non-lethal weapon, comprising:

a solid-state source to transmit a high-power millimeter-wave initial wavefront a main reflector a sub-reflector to reflect the initial wavefront to the main reflector wherein the main reflector directs the reflected wavefront in a bore-sighted direction toward a target and generates a converging wavefront to converge at or near the target, wherein a convergence distance is determined to provide a predetermined power density at or near a surface of the target a rangefinder to determine a distance to the target a focusing element to change the convergence distance based on the distance to the target determined by the rangefinder.

4. The non-lethal weapon of claim 3, wherein the focusing element comprises a millimeter-wave radio frequency lens.

5. The non-lethal weapon of claim 3, wherein the focusing element is the sub-reflector.

6. The non-lethal weapon of claim 3, wherein the focusing element is the solid-state source.

7. The non-lethal weapon of claim 3, further comprising a controller to change a focus of the focusing element in response to changes in the distance to the target, wherein the focusing element is to change the convergence distance to generate a predetermined power density at or near the target.

8. A non-lethal weapon, comprising:

a solid-state source comprising a high-power millimeter-wave amplifier to transmit a high-power millimeter-wave initial wavefront a main reflector a sub-reflector to reflect the initial wavefront to the main reflector wherein the main reflector is to direct the reflected wavefront in a bore-sighted direction toward a target, and wherein the high-power millimeter-wave amplifier further comprises an array of semiconductor amplifiers, each semiconductor amplifier having an output coupled to corresponding antenna element of an array of antenna elements.

9. The non-lethal weapon of claim 8, wherein the initial wavefront is spatially combined from wavefronts radiated by the array of antenna elements.

10. A non-lethal weapon, comprising:

a solid-state source comprising a high-power millimeter-wave amplifier to transmit a high-power millimeter-wave initial wavefront a replaceable energy-storage module to provide electrical energy for the millimeter-wave amplifier a main reflector a sub-reflector to reflect the initial wavefront to the main reflector wherein the main reflector is to direct the reflected wavefront in a bore-sighted direction toward a target.

11. The non-lethal weapon of claim 10, further comprising a cooling element to cool the millimeter-wave amplifier, wherein the cooling element includes a reservoir, wherein the reservoir is replaceable and is replaced as part of the replaceable energy-storage module.

12. A non-lethal weapon, comprising:

a solid-state source to transmit a high-power millimeter-wave initial wavefront a main reflector a sub-reflector to reflect the initial wavefront to the main reflector wherein the main reflector is to direct the reflected wavefront in a bore-sighted direction toward a target, and wherein the main reflector is a geometrically-flat electrically-parabolic surface reflector antenna having a plurality of antenna elements to receive and retransmit an incident wavefront, the antenna elements having circumferentially varying sizes arranged circumferentially around a center of the main reflector to generate either a collimating or converging wavefront.

13. A portable solid state millimeter wave directed energy weapon, comprising solid state source to transmit a high-power millimeter-wave initial wavefront a main reflector a sub-reflector to reflect the initial wavefront to the main reflector a rangefinder to determine a distance to the target wherein the main reflector is to direct the reflected wavefront in a bore-sighted direction toward a target the reflected wavefront comprises W-band millimeter-wave frequency radiation selected to penetrate a shallow skin-depth of human skin allowing the radiation to heat a region of the skin that includes pain sensors a power density at the target is selected to cause a deterring effect by inducing pain on the human skin the selected power density of the directed wavefront at or near the target is generated based on the determined distance.

14. The portable solid state millimeter wave directed energy weapon of claim 13, further comprising a focusing element to change a focus distance of the directed wavefront based on the distance to the target.

15. A portable, solid state millimeter wave directed energy weapon, comprising:

solid state source to transmit a high-power millimeter-wave initial wavefront a main reflector a sub-reflector to reflect the initial wavefront to the main reflector a laser designator to visually designate a target wherein the main reflector is to direct the reflected wavefront in a direction bore-sighted with the laser designator the reflected wavefront comprises W-band millimeter-wave frequency radiation selected to penetrate a shallow skin-depth of human skin allowing the radiation to heat a region of the skin that includes pain sensors a power density at the target is selected to cause a deterring effect by inducing pain on the human skin.

16. A portable solid state millimeter wave directed energy weapon, comprising:

a solid state source comprising a high-power millimeter-wave amplifier to transmit a high-power millimeter-wave initial wavefront a cooling element to cool the amplifier, wherein the cooling element includes a reservoir, wherein the reservoir is replaceable and is replaced as part of a replaceable energy-storage module a main reflector a sub-reflector to reflect the initial wavefront to the main reflector wherein the main reflector is to direct the reflected wavefront in a bore-sighted direction toward a target the reflected wavefront comprises W-band millimeter-wave frequency radiation selected to penetrate a shallow skin-depth of human skin allowing the radiation to heat a region of the skin that includes pain sensors a power density at the target is selected to cause a deterring effect by inducing pain on the human skin.

17. A portable solid state millimeter wave directed energy weapon, comprising:

a solid state source to transmit a high-power millimeter-wave initial wavefront a main reflector a sub-reflector to reflect the initial wavefront to the main reflector wherein the main reflector is a geometrically-flat electrically-parabolic surface reflector antenna having a plurality of antenna elements to receive and retransmit an incident wavefront, the antenna elements having circumferentially varying sizes arranged circumferentially around a center of the main reflector to generate either a collimating or converging wavefront the main reflector is to direct the reflected wavefront in a bore-sighted direction toward a target the reflected wavefront comprises W-band millimeter-wave frequency radiation selected to penetrate a shallow skin-depth of human skin allowing the radiation to heat a region of the skin that includes pain sensors a power density at the target is selected to cause a deterring effect by inducing pain on the human skin.

18. The portable solid state millimeter wave directed energy weapon of claim 17, wherein the main reflector is to generate a converting wavefront to converge at or near the target, wherein a convergence distance is determined to provide a predetermined power density at or near a surface of the target.

19. The portable solid state millimeter wave directed energy weapon of claim 18, wherein the main reflector is selected from the group consisting of a reflector foldable into two or more flat sections, wherein one of the sections is hinged, and wherein the two or more flat sections fold up at least partially around the weapon, and a single flat panel reflector that is detachable from the weapon.

* * * * *